US011111651B2

(12) United States Patent
Shimizu et al.

(10) Patent No.: US 11,111,651 B2
(45) Date of Patent: Sep. 7, 2021

(54) CONSTRUCTION MACHINE

(71) Applicant: Hitachi Construction Machinery Co., Ltd., Tokyo (JP)

(72) Inventors: Juri Shimizu, Tokyo (JP); Kenji Hiraku, Tsuchiura (JP); Hiromasa Takahashi, Tsuchiura (JP); Teppei Saitou, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 17/054,869

(22) PCT Filed: May 20, 2019

(86) PCT No.: PCT/JP2019/019861

§ 371 (c)(1),
(2) Date: Nov. 12, 2020

(87) PCT Pub. No.: WO2020/003810

PCT Pub. Date: Jan. 2, 2020

(65) Prior Publication Data

US 2021/0230839 A1 Jul. 29, 2021

(30) Foreign Application Priority Data

Jun. 26, 2018 (JP) ..... JP2018-120895

(51) Int. Cl.

*F15B 11/17* (2006.01)
*E02F 9/22* (2006.01)
*F15B 11/16* (2006.01)

(52) U.S. Cl.

CPC ..... *E02F 9/2296* (2013.01); *E02F 9/2235* (2013.01); *E02F 9/2267* (2013.01);
(Continued)

(58) Field of Classification Search

None
See application file for complete search history.

(56) References Cited

U.S. PATENT DOCUMENTS 4,369,625 A * 1/1983 Izumi ..... E02F 9/2292 414/699
6,244,048 B1 * 6/2001 Tanaka ..... E02F 9/2242 60/421
7,500,360 B2 * 3/2009 Udagawa ..... E02F 9/2228 60/421
9,845,589 B2 * 12/2017 Tsuruga ..... F15B 11/17
(Continued)

FOREIGN PATENT DOCUMENTS

JP 2015-48899 A 3/2015
JP 2015-209943 A 11/2015
JP 2018-84094 A 5/2018

OTHER PUBLICATIONS

International Search Report (PCT/ISA/210) issued in PCT Application No. PCT/JP2019/019861 dated Aug. 6, 2019 with English translation (two (2) pages).
Japanese-language Written Opinion (PCT/ISA/237) issued in PCT Application No. PCT/JP2019/019861 dated Aug. 6, 2019 (three (3) pages).
(Continued)

*Primary Examiner* — Michael Leslie
(74) *Attorney, Agent, or Firm* — Crowell & Moring LLP

(57) ABSTRACT

An object of the present invention is to provide a construction machine that has a hydraulic closed-circuit system mounted therein and capable of selectively connecting some of a plurality of hydraulic pumps driven by two engines to any one of a plurality of hydraulic actuators and that can downsize the engines while maintaining high work efficiency. A controller 80 includes an actuator/engine allocation computing section F6 that, at the time of connecting closed-circuit pumps that are not connected to any of the hydraulic actuators 1, 3, 5, and 7 to any one of the hydraulic actuators, allocates closed-circuit pumps driven by a right engine 9*b* to the one hydraulic actuator in a case in which an estimated maximum load on a left engine 9*a* is heavier than an estimated maximum load on the right engine, and allo-
(Continued)

FIRST ACTUATOR/ENGINE ALLOCATION MAP

M1

| ACTUATOR | CLOSED-CIRCUIT PUMP SET |
|---|---|
| BOOM CYLINDER 1 | ENGINE 9a SIDE |
| ARM CYLINDER 3 | ENGINE 9b SIDE |
| BUCKET CYLINDER 5 | ENGINE 9a SIDE |
| SWING MOTOR 7 | ENGINE 9b SIDE |

CHANGE OVER AT PREDETERMINED TIMING

SECOND ACTUATOR/ENGINE ALLOCATION MAP

M2

| ACTUATOR | CLOSED-CIRCUIT PUMP SET |
|---|---|
| BOOM CYLINDER 1 | ENGINE 9b SIDE |
| ARM CYLINDER 3 | ENGINE 9a SIDE |
| BUCKET CYLINDER 5 | ENGINE 9b SIDE |
| SWING MOTOR 7 | ENGINE 9a SIDE |

cates closed-circuit pumps driven by the left engine to the one hydraulic actuator in a case in which the estimated maximum load on the right engine is heavier than the estimated maximum load on the left engine.

5 Claims, 9 Drawing Sheets

(52) U.S. Cl.
CPC ..... *E02F 9/2289* (2013.01); *E02F 9/2292* (2013.01); *F15B 11/163* (2013.01); *F15B 11/17* (2013.01); *F15B 2211/20523* (2013.01); *F15B 2211/20546* (2013.01); *F15B 2211/20576* (2013.01); *F15B 2211/30565* (2013.01); *F15B 2211/633* (2013.01); *F15B 2211/6313* (2013.01); *F15B 2211/6346* (2013.01)

(56) References Cited

U.S. PATENT DOCUMENTS

| | | | | |
|---|---|---|---|---|
| 10,385,892 | B2 * | 8/2019 | Cugati | E02F 3/404 |
| 10,829,908 | B2 * | 11/2020 | Saitoh | E02F 9/2289 |
| 2011/0056194 | A1 * | 3/2011 | Wojcicki | F15B 11/17 60/428 |
| 2016/0032565 | A1 | 2/2016 | Shimizu et al. | |
| 2018/0172037 | A1 | 6/2018 | Cugati et al. | |
| 2019/0218750 | A1 | 7/2019 | Saitoh et al. | |

OTHER PUBLICATIONS

International Preliminary Report on Patentability (PCT/IB/338 & PCT/IB/373) issued in PCT Application No. PCT/JP2019/019861 dated Jan. 7, 2021 including English translation of document C2 (Japanese-language Written Opinion (PCT/ISA/237), filed on Nov. 12, 2020) (five (5) pages).

* cited by examiner

FIG. 7

FIRST ACTUATOR/ENGINE ALLOCATION MAP

M1

| ACTUATOR | CLOSED-CIRCUIT PUMP SET |
|---|---|
| BOOM CYLINDER 1 | ENGINE 9a SIDE |
| ARM CYLINDER 3 | ENGINE 9b SIDE |
| BUCKET CYLINDER 5 | ENGINE 9a SIDE |
| SWING MOTOR 7 | ENGINE 9b SIDE |

CHANGE OVER AT PREDETERMINED TIMING

SECOND ACTUATOR/ENGINE ALLOCATION MAP

M2

| ACTUATOR | CLOSED-CIRCUIT PUMP SET |
|---|---|
| BOOM CYLINDER 1 | ENGINE 9b SIDE |
| ARM CYLINDER 3 | ENGINE 9a SIDE |
| BUCKET CYLINDER 5 | ENGINE 9b SIDE |
| SWING MOTOR 7 | ENGINE 9a SIDE |

CONSTRUCTION MACHINE

TECHNICAL FIELD

The present invention relates to a construction machine such as a hydraulic excavator with two engines mounted therein.

BACKGROUND ART

In recent years, energy saving of a construction machine such as a hydraulic excavator and a wheel loader has been regarded as an important item for development. To achieve the energy saving of the construction machine, the energy saving of a hydraulic system itself is important and application of a hydraulic system (hereinafter, referred to as "hydraulic closed-circuit system") using a hydraulic closed circuit that makes a closed-circuit connection between hydraulic pumps and hydraulic actuators for directly feeding/discharging a hydraulic fluid is under consideration. In the hydraulic closed circuit, no pressure loss by control valves occurs and no flow rate loss occurs either since each pump delivers the hydraulic fluid only at a necessary flow rate. The hydraulic closed circuit also enables regeneration of potential energy of the hydraulic actuators and energy during deceleration. Owing to this, the application of the hydraulic closed-circuit system makes it possible to achieve the energy saving of the construction machine.

Patent Document 1, for example, discloses a hydraulic closed-circuit system applied to a construction machine. Patent Document 1 describes a configuration such that some of a plurality of hydraulic pumps are selectively connected to any one of a plurality of hydraulic actuators via a solenoid selector valve to create a closed circuit, thereby enabling a combined operation and a high-speed operation of each hydraulic actuator.

PRIOR ART DOCUMENT

Patent Document

Patent Document 1: JP-2015-48899-A

SUMMARY OF THE INVENTION

Problem to be Solved by the Invention

For example, an extra-large mining excavator has two engines mounted therein. In such a construction machine having the two engines mounted therein, in a case in which loads of hydraulic actuators are unevenly imposed on one of the engines, occurrence of a scarcity of power in the one engine possibly causes degradation in work efficiency. It is, therefore, necessary to make each engine large in size to maintain high work efficiency.

The present invention has been achieved in light of the problems, and an object of the present invention is to provide a construction machine that has a hydraulic closed-circuit system mounted therein and capable of selectively connecting some of a plurality of hydraulic pumps driven by two engines to any one of a plurality of hydraulic actuators, and that achieves downsizing of the engines while maintaining high work efficiency.

Means for Solving the Problem

To attain the object, the present invention provides a construction machine including a first engine, a second engine, a plurality of bidirectionally variable displacement first hydraulic pumps driven by the first engine, a plurality of bidirectionally variable displacement second hydraulic pumps driven by the second engine, a plurality of hydraulic actuators, an operation device for instructing operation amounts of the plurality of hydraulic actuators, a plurality of selector valves selectively connecting the plurality of first hydraulic pumps and the plurality of second hydraulic pumps to any one of the plurality of hydraulic actuators, and a controller controlling the plurality of first hydraulic pumps, the plurality of second hydraulic pumps, and the plurality of selector valves according to an input from the operation device. The controller includes an engine load computing section that computes a total of estimated maximum demanded power of first hydraulic pumps connected to the plurality of hydraulic actuators among the plurality of first hydraulic pumps as an estimated maximum load on the first engine and that computes a total of estimated maximum demanded power of second hydraulic pumps connected to any of the plurality of hydraulic actuators among the plurality of second hydraulic pumps as an estimated maximum load on the second engine, an actuator/engine allocation computing section that, at a time of connecting first or second hydraulic pumps that are not connected to any of the plurality of hydraulic actuators among the plurality of first hydraulic pumps and the plurality of second hydraulic pumps to any one of the plurality of hydraulic actuators, allocates second hydraulic pumps that are not connected to any of the plurality of hydraulic actuators among the plurality of second hydraulic pumps to the one hydraulic actuator in a case in which the estimated maximum load on the first engine is heavier than the estimated maximum load on the second engine and allocates first hydraulic pumps that are not connected to any of the plurality of hydraulic actuators among the plurality of first hydraulic pumps to the one hydraulic actuator in a case in which the estimated maximum load on the second engine is heavier than the estimated maximum load on the first engine, and a command computing section that generates command signals to the plurality of first hydraulic pumps, the plurality of second hydraulic pumps, and the plurality of selector valves according to a computing result of the actuator/engine allocation computing section.

According to the present invention configured as described above, connecting the first or second hydraulic pumps driven by the engine having the lighter estimated maximum load out of the first and second engines to the hydraulic actuator requesting connection of hydraulic pumps to the hydraulic actuator enables leveling out maximum demanded power of the first and second engines. It is thereby possible to downsize the first and second engines while maintaining high work efficiency of the construction machine.

Advantages of the Invention

According to the present invention, in a construction machine having a hydraulic closed-circuit system mounted therein and capable of selectively connecting some of a plurality of hydraulic pumps driven by two engines to any one of a plurality of hydraulic actuators, it is possible to downsize the engines while maintaining high work efficiency by levelling out maximum demanded power of the engines.

BRIEF DESCRIPTION OF THE DRAWINGS

FIG. 7 is a diagram depicting an example of actuator/engine allocation maps.

MODES FOR CARRYING OUT THE INVENTION

Figure 1:
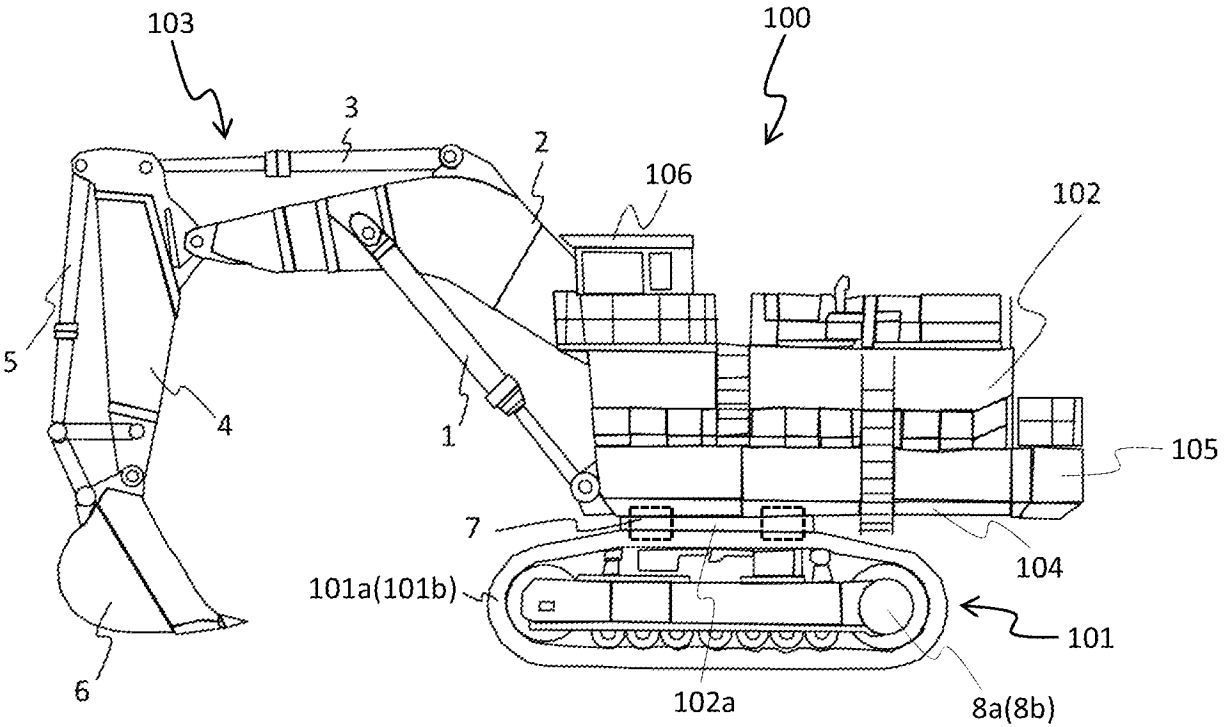
FIG. 1 is a side view of a hydraulic excavator that is an example of a construction machine according to an embodiment of the present invention.

A hydraulic excavator will be described hereinafter as an example of a construction machine according to an embodiment of the present invention with reference to the drawings. It is noted that equivalent members are denoted by same reference characters in the drawings and repetitive description will be omitted.

FIG. 1 is a side view of a hydraulic excavator according to the present embodiment. As depicted in FIG. 1, a hydraulic excavator 100 is configured with a lower travel structure 101 equipped with left and right crawler travel devices 101*a* and 101*b*, an upper swing structure 102 swingably mounted on the lower travel structure 101 via a swing device 102*a*, and a front implement 103 vertically rotatably attached to a front side of the upper swing structure 102. The travel devices 101*a* and 101*b* are driven by hydraulic motors (hereinafter, referred to as "travel motors") 8*a* and 8*b*, and the swing device 102*a* is driven by a hydraulic motor (hereinafter, referred to as "swing motor") 7.

The front implement 103 is vertically rotatably attached to a front portion of a swing frame 104 that forms a base lower structure of the upper swing structure 102. A counterweight 105 that keeps weight balance between the upper swing structure 102 and the front implement 103 is provided on a rear end side of the swing frame 104. A cab 106 in which an operator is on board is provided on a left side of the front portion of the swing frame 104 and a left side of the front implement 103. Levers (an operation device) 81 (depicted in FIG. 2) operated by the operator and instructing operation amounts of actuators are disposed within the cab 106.

The front implement 103 is configured with a boom 2 having a base end portion vertically rotatably attached to the front portion of the swing frame 104, an arm 4 vertically and longitudinally rotatably attached to a tip end portion of the boom 2, a bucket 6 vertically and longitudinally rotatably attached to a tip end portion of the arm 4, a single-rod hydraulic cylinder (hereinafter, referred to as "boom cylinder") 1 rotating the boom 2, a single-rod hydraulic cylinder (hereinafter, referred to as "arm cylinder") 3 rotating the arm 4, and a single-rod hydraulic cylinder (hereinafter, referred to as "bucket cylinder") 5 rotating the bucket 6.

Figure 2:
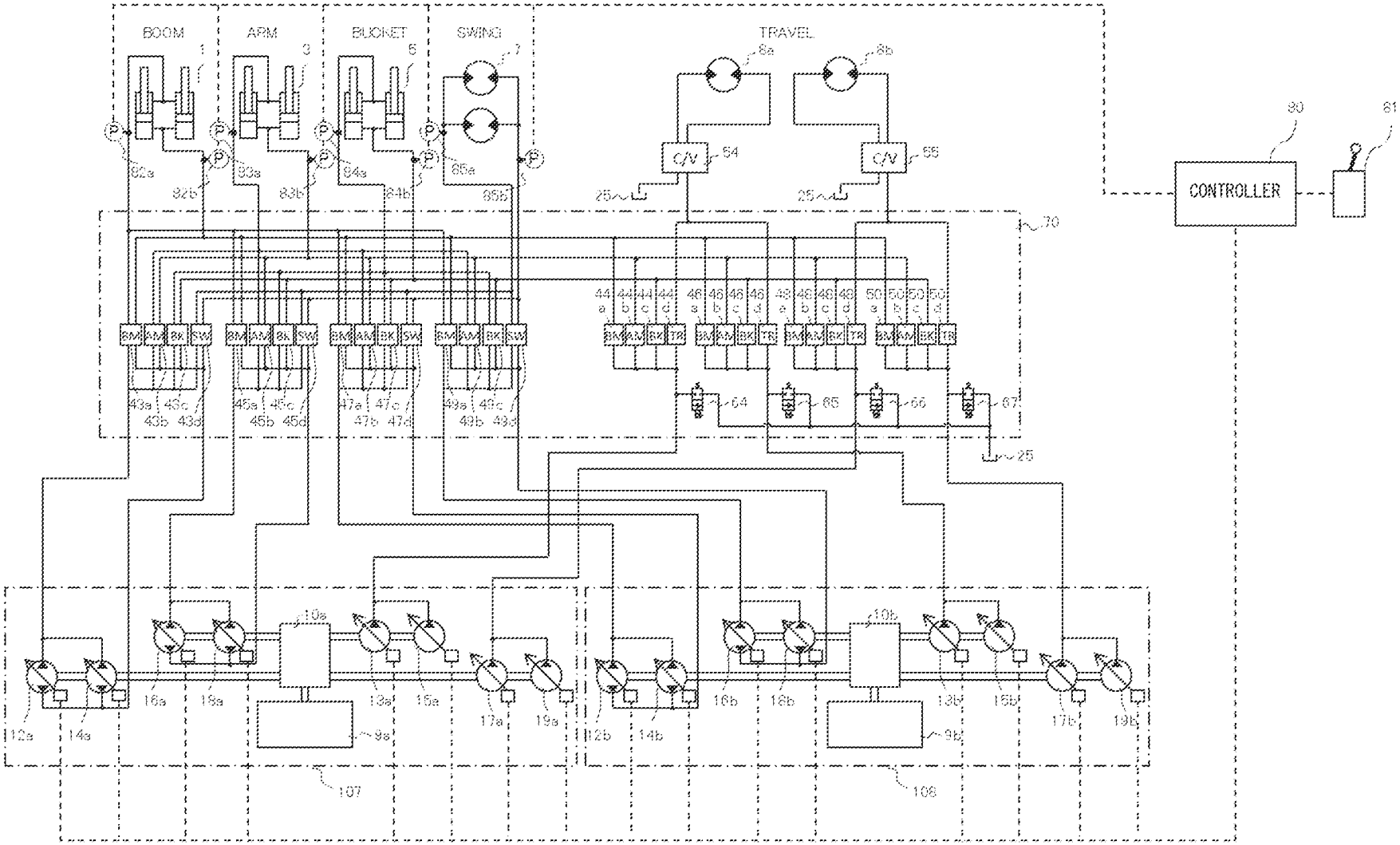
FIG. 2 is a hydraulic circuit diagram of a hydraulic closed-circuit system mounted in the hydraulic excavator depicted in FIG. 1.

FIG. 2 is a hydraulic circuit diagram of a hydraulic closed-circuit system mounted in the hydraulic excavator 100 depicted in FIG. 1. It is noted that a charge pump for holding an ordinary circuit pressure, a flushing valve and a makeup check valve for compensating for excess or deficiency of a hydraulic fluid within a closed circuit, a relief valve for specifying a highest pressure of the circuit and protecting the circuit, and the like are not depicted in FIG. 2 for avoiding complicated representation although these pump and valves are provided in the hydraulic closed circuit.

In FIG. 2, a left engine (first engine) 9*a* drives bidirectionally variable displacement hydraulic pumps (hereinafter, referred to as "closed-circuit pumps") 12*a*, 14*a*, 16*a*, and 18*a* and unidirectionally variable displacement hydraulic pumps (hereinafter, referred to as "open-circuit pumps") 13*a*, 15*a*, 17*a*, and 19*a* via a power transmission device 10*a*. A right engine (second engine) 9*b* drives closed-circuit pumps 12*b*, 14*b*, 16*b*, and 18*b* and open-circuit pumps 13*b*, 15*b*, 17*b*, and 19*b* via a power transmission device 10*b*. The left engine 9*a*, the power transmission device 10*a*, the closed-circuit pumps (first hydraulic pumps) 12*a*, 14*a*, 16*a*, and 18*a*, and the open-circuit pumps 13*a*, 15*a*, 17*a*, and 19*a* are disposed in a left engine room 107, while the right engine 9*b*, the power transmission device 10*b*, the closed-circuit pumps (second hydraulic pumps) 12*b*, 14*b*, 16*b*, and 18*b*, and the open-circuit pumps 13*b*, 15*b*, 17*b*, and 19*b* are disposed in a right engine room 108.

Delivery ports of the closed-circuit pumps 12*a* and 14*a* are merged together in a pipe and then connected to selector valves 43*a* to 43*d* that serve as closed-circuit selector valves. A pair of the two closed-circuit pumps having the delivery ports merged together in this way will be referred to as a "closed-circuit pump set," as appropriate. Each selector valve changes over between conduction and interruption of a line in response to a signal from a controller 80, and is set into an interruption state without a signal.

The selector valve 43*a* is connected to the boom cylinder 1 via a pipe, and the closed-circuit pumps 12*a* and 14*a* are connected to the boom cylinder 1 to configure a closed circuit when the selector valve 43*a* is set into a conductive state. The selector valve 43*b* is connected to the arm cylinder 3 via a pipe, and the closed-circuit pumps 12*a* and 14*a* are connected to the arm cylinder 3 to configure a closed circuit when the selector valve 43*b* is set into a conductive state. The selector valve 43*c* is connected to the bucket cylinder 5 via a pipe, and the closed-circuit pumps 12*a* and 14*a* are connected to the bucket cylinder 5 to configure a closed circuit when the selector valve 43*c* is set into a conductive state. The selector valve 43*d* is connected to the swing motor 7 via a pipe, and the closed-circuit pumps 12*a* and 14*a* are connected to the swing motor 7 to configure a closed circuit when the selector valve 43*d* is set into a conductive state.

Like the pair of the closed-circuit pumps 12*a* and 14*a*, each pair of a pair of closed-circuit pumps 16*a* and 18*a*, a pair of closed-circuit pumps 12*b* and 14*b*, and a pair of closed-circuit pumps 16*b* and 18*b* are selectively connected to any one of the boom cylinder 1, the arm cylinder 3, the bucket cylinder 5, and the swing motor 7 via selector valves 45*a* to 45*d*, selector valves 47*a* to 47*d*, or selector valves 49*a* to 49*d* to configure a closed circuit after delivery ports thereof are merged together in a pipe.

Delivery ports of the open-circuit pumps 13*a* and 15*a* are merged together in a pipe and then connected to selector valves 44*a* to 44*d* that serve as open-circuit selector valves and to a bleed-off valve 64. Each of the selector valves 44*a* to 44*d* changes over between conduction and interruption of a line in response to a signal from the controller 80, and is set into an interruption state without a signal. The selector valve 44*a* is connected to a cap side of the boom cylinder 1 via a pipe, the selector valve 44*b* is connected to a cap side of the arm cylinder 3 via a pipe, the selector valve 44*c* is connected to a cap side of the bucket cylinder 5 via a pipe, and the selector valve 44*d* is connected to a control valve 54 via a pipe, and the open-circuit pumps 13*a* and 15*a* are selectively connected to any one of the actuators 1, 3, 5, and 8*a* by setting any one of the selector valves 44*a* to 44*d* into a conductive state.

Delivery ports of the open-circuit pumps 17*a* and 19*a* are merged together in a pipe and then connected to selector valves 48*a* to 48*d* that serve as open-circuit selector valves and to a bleed-off valve 66. Each of the selector valves 48*a* to 48*d* changes over between conduction and interruption of a line in response to a signal from the controller 80, and is set into an interruption state without a signal. The selector valve 48*a* is connected to the cap side of the boom cylinder 1 via a pipe, the selector valve 48*b* is connected to the cap side of the arm cylinder 3 via a pipe, the selector valve 48*c* is connected to the cap side of the bucket cylinder 5 via a pipe, and the selector valve 48*d* is connected to a control valve 55 via a pipe, and the open-circuit pumps 13*a* and 15*a* are selectively connected to any one of the actuators 1, 3, 5, and 8*b* by setting any one of the selector valves 46*a* to 46*d* into a conductive state.

Delivery ports of the open-circuit pumps 13*b* and 15*b* are merged together in a pipe and then connected to selector valves 46*a* to 46*d* that serve as open-circuit selector valves and to a bleed-off valve 65. Each of the selector valves 46*a* to 46*d* changes over between conduction and interruption of a line in response to a signal from the controller 80, and is set into an interruption state without a signal. The selector valve 46*a* is connected to the cap side of the boom cylinder 1 via a pipe, the selector valve 46*b* is connected to the cap side of the arm cylinder 3 via a pipe, the selector valve 46*c* is connected to the cap side of the bucket cylinder 5 via a pipe, and the selector valve 46*d* is connected to the control valve 54 via a pipe, and the open-circuit pumps 13*b* and 15*b* are selectively connected to any one of the actuators 1, 3, 5, and 8*a* by setting any one of the selector valves 48*a* to 48*d* into a conductive state.

Delivery ports of the open-circuit pumps 17*b* and 19*b* are merged together in a pipe and then connected to selector valves 50*a* to 50*d* that serve as open-circuit selector valves and to a bleed-off valve 67. Each of the selector valves 50*a* to 50*d* changes over between conduction and interruption of a line in response to a signal from the controller 80, and is set into an interruption state without a signal. The selector valve 50*a* is connected to the cap side of the boom cylinder 1 via a pipe, the selector valve 50*b* is connected to the cap side of the arm cylinder 3 via a pipe, the selector valve 50*c* is connected to the cap side of the bucket cylinder 5 via a pipe, and the selector valve 50*d* is connected to the control valve 55 via a pipe, and the open-circuit pumps 13*a* and 15*a* are selectively connected to any one of the actuators 1, 3, 5, and 8*b* by setting any one of the selector valves 50*a* to 50*d* into a conductive state. The selector valves 43*a* to 50*d* and the bleed-off valves 64 to 67 are integrated as a hydraulic valve block 70 and mounted on the swing frame 104.

The control valve 54 adjusts a rotation direction and a rotational speed of the travel motor 8*a* by controlling directions and flow rates of hydraulic fluids supplied from the open-circuit pumps 13*a*, 15*a*, 13*b*, and 15*b* to the travel motor 8*a*. The control valve 55 adjusts a rotation direction and a rotational speed of the travel motor 8*b* by controlling directions and flow rates of hydraulic fluids supplied from the open-circuit pumps 17*a*, 19*a*, 17*b*, and 17*b* to the travel motor 8*b*.

A pressure sensor 82*a* connected to a rod-side port of the boom cylinder 1 measures a rod pressure of the boom cylinder 1 and inputs the measured rod pressure to the controller 80. A pressure sensor 82*b* connected to a cap-side port of the boom cylinder 1 measures a cap pressure of the boom cylinder 1 and inputs the measured cap pressure to the controller 80.

A pressure sensor 83*a* connected to a rod-side port of the arm cylinder 3 measures a rod pressure of the arm cylinder 3 and inputs the measured rod pressure to the controller 80. A pressure sensor 83*b* connected to a cap-side port of the arm cylinder 3 measures a cap pressure of the arm cylinder 3 and inputs the measured cap pressure to the controller 80.

A pressure sensor 84*a* connected to a rod-side port of the bucket cylinder 5 measures a rod pressure of the bucket cylinder 5 and inputs the measured rod pressure to the controller 80. A pressure sensor 84*b* connected to a cap-side port of the bucket cylinder 5 measures a cap pressure of the bucket cylinder 5 and inputs the measured cap pressure to the controller 80.

A pressure sensor 85*a* connected to a left port of the swing motor 7 measures a left-side pressure of the swing motor 7 and inputs the measured left-side pressure to the controller 80. A pressure sensor 85*b* connected to a right port of the swing motor 7 measures a right-side pressure of the swing motor 7 and inputs the measured right-side pressure to the controller 80. The pressure sensors 82*a* to 85*b* configure a pressure sensor that detects pressures of the actuators 1, 3, 5, and 7.

The controller 80 controls the selector valves, the closed-circuit pumps, the open-circuit pumps, the bleed-off valves 64 to 67, and the control valves 54 and 55 according to the operation amounts of the actuators input from the levers 81 and the pressures of the actuators input from the pressure sensors 82*a* to 85*b*. The controller 80 is configured with, for example, a microcomputer and the like, and exercises various kinds of control by causing a CPU to execute a program stored in a ROM.

In the hydraulic closed-circuit system configured as described above, it is possible to accelerate the hydraulic actuators 1, 3, 5, 7, 8*a*, and 8*b* by increasing the number of hydraulic pumps connected to the hydraulic actuators 1, 3, 5, 7, 8*a*, and 8*b*.

Furthermore, supplying the hydraulic fluids from the open-circuit pumps to the cap sides at the time of driving the single-rod hydraulic cylinders 1, 3, and 5 to expand and returning part of hydraulic operating fluids discharged from the cap sides to a hydraulic operating fluid tank 25 via the bleed-off valves 64 to 67 at the time of driving the single-rod hydraulic cylinders 1, 3, and 5 to contract make it possible to resolve a speed difference between the time of driving the single-rod hydraulic cylinders 1, 3, and 5 to expand and the time of driving the single-rod hydraulic cylinders 1, 3, and 5 to contract.

Moreover, configuring the hydraulic closed-circuit system in such a manner as to merge the closed-circuit pumps or the open-circuit pumps driven by the same engine (that is, disposed to be close to each other) together into one pipe and to connect the one pipe after merge to the selector valve facilitates managing the pipes; thus, it is possible to improve mountability of the hydraulic closed-circuit system into a body. While the closest closed-circuit pumps and the closest open-circuit pumps are configured as pairs in each of the engine rooms 107 and 108 in the example depicted in FIG. 2, the closed-circuit pumps and the open-circuit pumps may be paired in any manner if being disposed in the same engine room. Furthermore, a pair of two closed-circuit pumps and a pair of two open-circuit pumps may be replaced by one closed-circuit pump and one open-circuit pump each having a delivery capacity corresponding to delivery capacities of two pumps, respectively.

Figure 3:
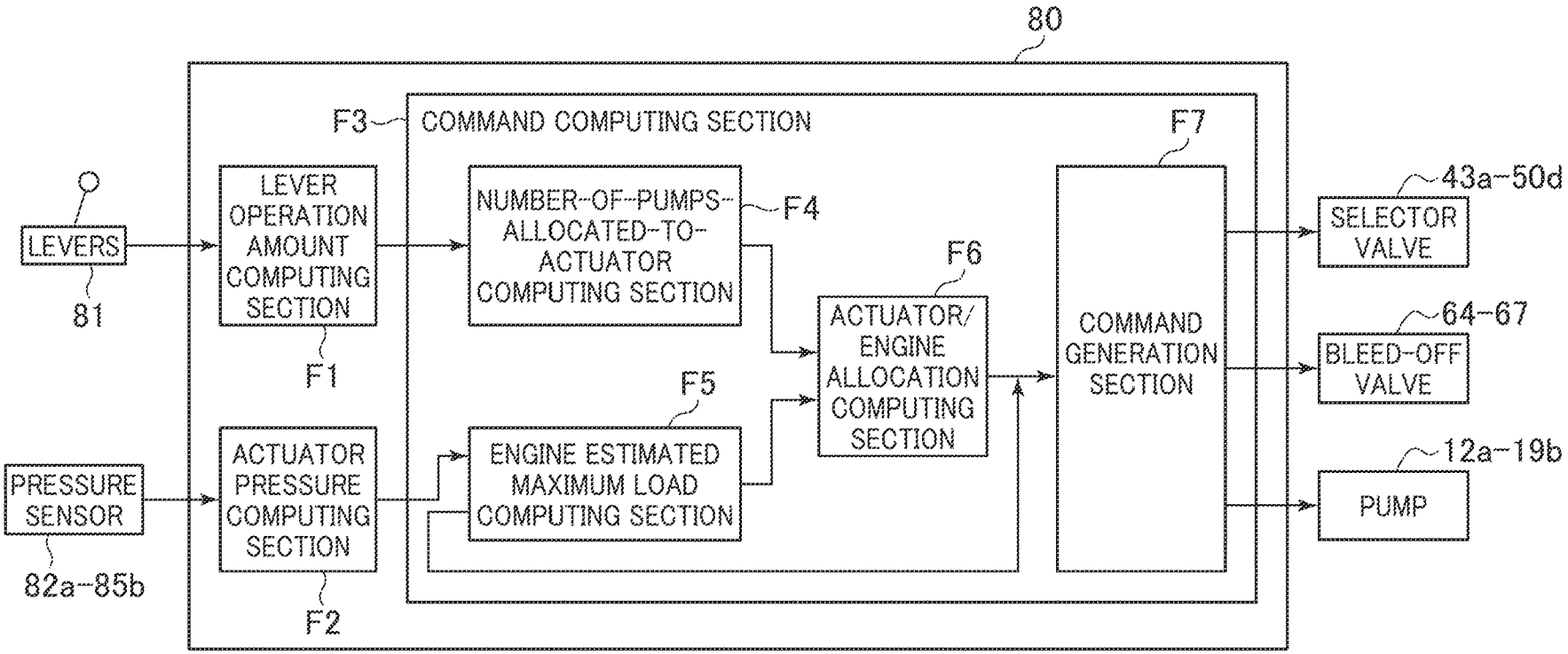
FIG. 3 is a functional block diagram of a controller depicted in FIG. 2.

FIG. 3 depicts a functional block diagram of the controller 80. The controller 80 has a lever operation amount computing section F1, an actuator pressure computing section F2, and a command computing section F3. The command computing section F3 has a number-of-pumps-allocated-to-actuator computing section F4, an engine estimated maximum load computing section F5, an actuator/engine allocation computing section F6, and a command generation section F7. It is noted that parts associated with control of the control valves 54 and 55 are not depicted in FIG. 3.

The lever operation amount computing section F1 computes operating directions, target operating speeds, and demanded flow rates of the actuators 1, 3, 5, and 7 on the basis of inputs from the levers 81, and inputs the computed operating directions, target operating speeds, and demanded flow rates to the number-of-pumps-allocated-to-actuator computing section F4.

The actuator pressure computing section F2 computes the pressures of the actuators 1, 3, 5, and 7 from values of the pressure sensors 82*a* to 85*b* provided in respective portions, and inputs the computed pressures to the engine estimated maximum load computing section F5.

The number-of-pumps-allocated-to-actuator computing section F4 computes the number of pumps allocated to each actuator on the basis of the demanded flow rates of the actuators, and inputs the computed number of pumps to the actuator/engine allocation computing section F6.

The engine estimated maximum load computing section F5 computes delivery pressures and suction pressures of the pumps on the basis of the pressures of the actuators, a pressure loss generated in the pipe between each actuator and the pumps, and combination of connections of the actuators and the engines computed previously by the actuator/engine allocation computing section F6. Furthermore, the engine estimated maximum load computing section F5 computes estimated maximum loads of the engines from the computed delivery pressures and suction pressures of the pumps and maximum delivery flow rates of the pumps, and inputs the computed estimated maximum loads to the actuator/engine allocation computing section F6. The estimated maximum load on each engine means herein a total of maximum power (hereinafter, referred to as "estimated maximum demanded power") that can be demanded by each pump connected to any of the actuators to the engine. The estimated maximum demanded power of the pump can be obtained by multiplying, by the maximum delivery flow rate of the pump, a differential pressure between an estimated delivery pressure and an estimated suction pressure of the pump each obtained by adding the pressure loss generated in the pipe between the hydraulic actuator to which the pump is connected and the pump to an actual pressure (or standard pressure estimated in advance) of the hydraulic actuator. The maximum delivery flow rate of the pump can be obtained by multiplying a rated revolution speed of the engine driving the pump by a maximum tilting angle (maximum delivery capacity) of the pump.

The actuator/engine allocation computing section F6 allocates the engine for driving each actuator to the actuator on the basis of the number of pumps allocated to the actuator and the estimated maximum load on each engine, and inputs a result of allocation to the engine load computing section F5 and the command generation section F7.

The command generation section F7 generates command signals to the selector valves, the bleed-off valves, and the pumps on the basis of a computing result of the actuator/engine allocation computing section F6, and outputs the generated command signals.

Figure 4:
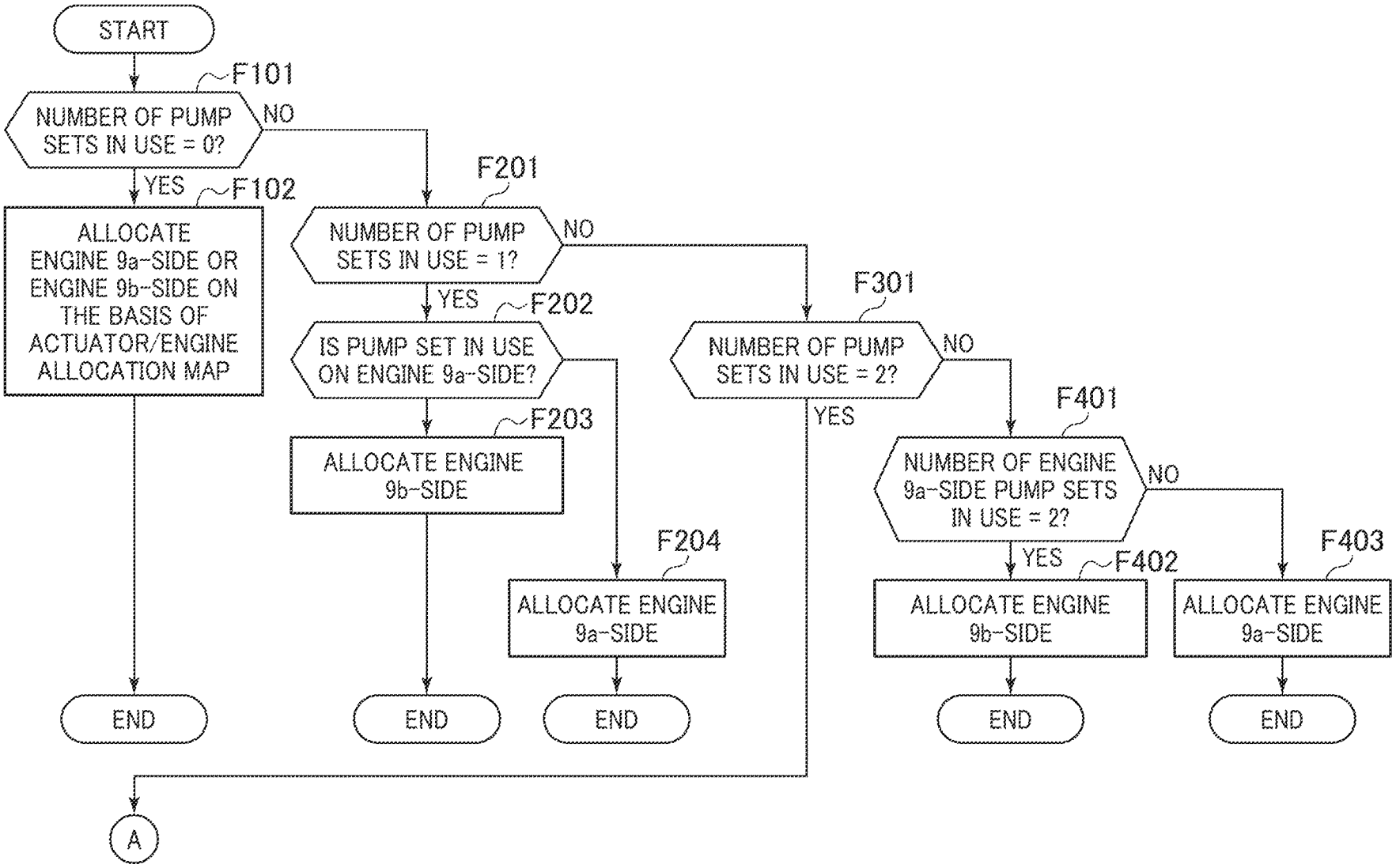
FIG. 4 is a flowchart (1/3) depicting computing processing by an actuator/engine allocation computing section depicted in FIG. 2.
Figure 5:
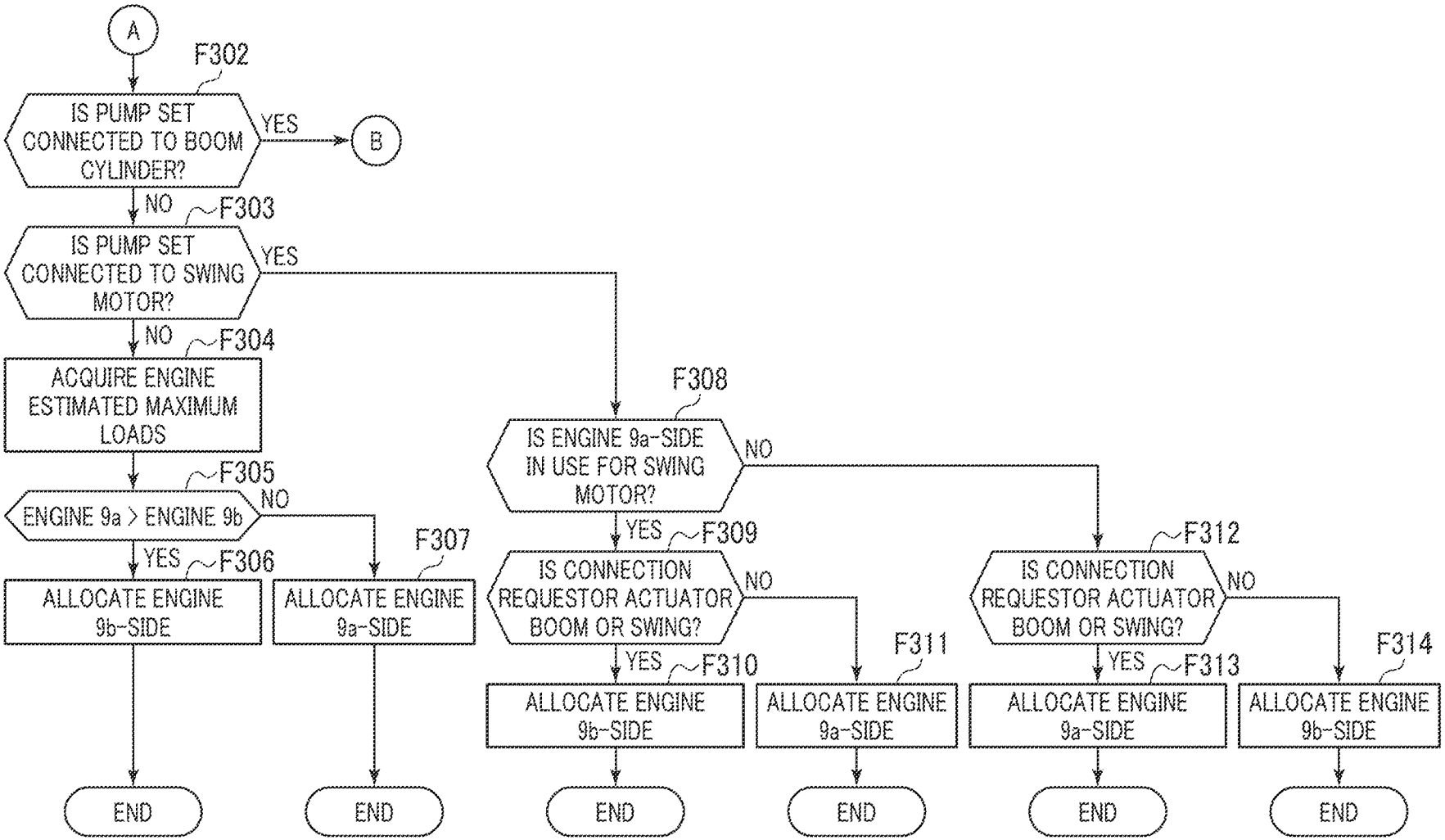
FIG. 5 is a flowchart (2/3) depicting the computing processing by the actuator/engine allocation computing section depicted in FIG. 2.
Figure 6:
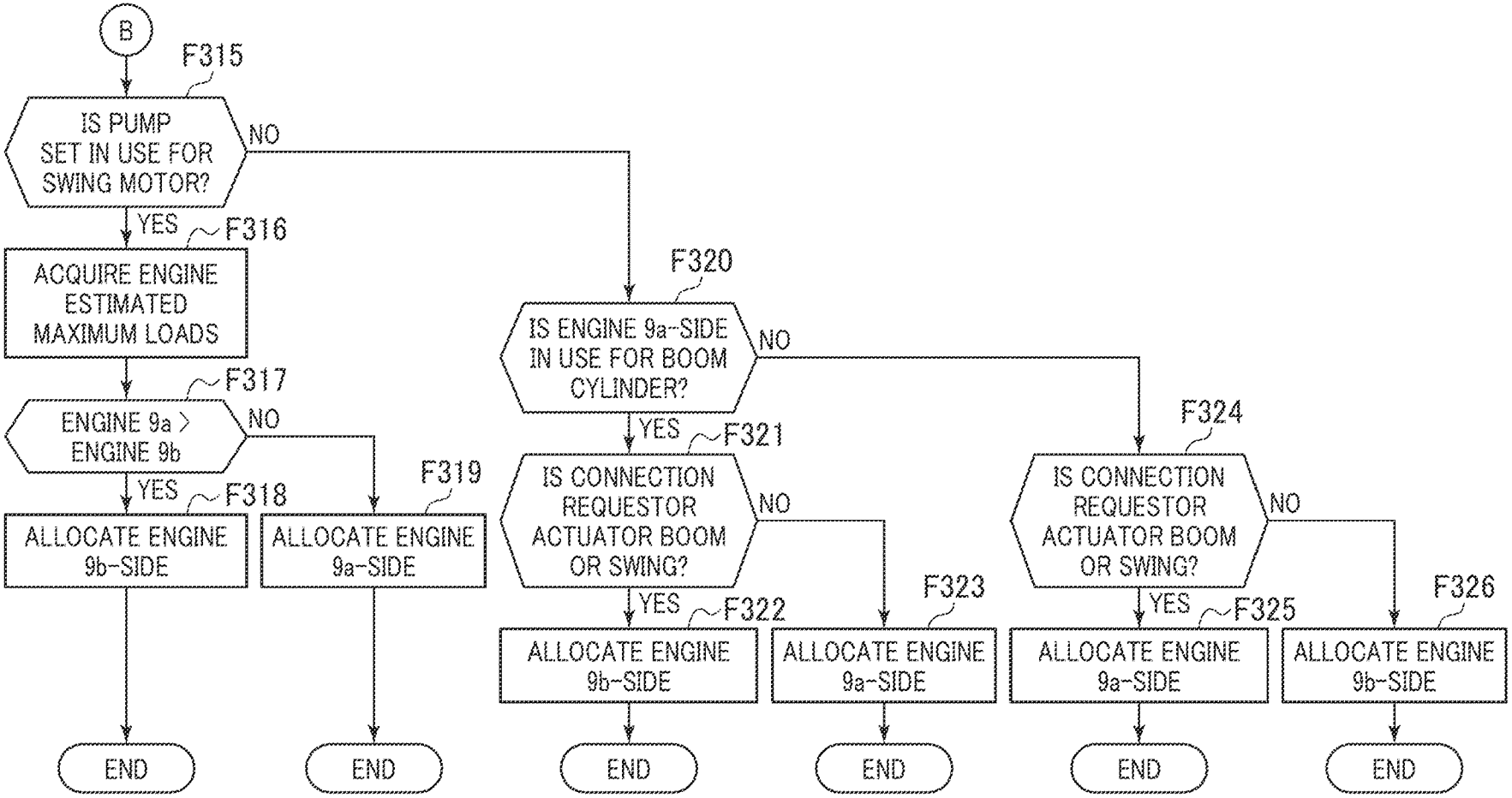
FIG. 6 is a flowchart (3/3) depicting the computing processing by the actuator/engine allocation computing section depicted in FIG. 2.

FIGS. 4 to 6 are flowcharts depicting computing processing by the actuator/engine allocation computing section F6. It is noted that processing associated with control over the open-circuit pumps and the bleed-off valves is not depicted in FIGS. 4 to 6. Steps will be described hereinafter in sequence.

First, in Step F101, the actuator/engine allocation computing section F6 determines whether the number of closed-circuit pump sets (hereinafter, referred to as "pump sets in use") connected to any one of the hydraulic actuators 1, 3, 5, and 7 is zero.

In a case in which a determination result is YES (the number of pump sets in use is zero) in Step F101, the actuator/engine allocation computing section F6 allocates the engine 9*a*-side or engine 9*b*-side closed-circuit pump set to the hydraulic actuator (hereinafter, referred to as "connection requestor actuator") requesting connection of the closed-circuit pump set on the basis of an actuator/engine allocation map (to be described later) in Step F102 and ends the flow.

FIG. 7 depicts an example of actuator/engine allocation maps. The actuator/engine allocation computing section F6 according to the present embodiment is configured to use any of first and second actuator/engine allocation maps M1 and M2 depicted in FIG. 7 in Step F202 depicted in FIG. 4 by changing over between the first and second actuator/engine allocation maps M1 and M2 at predetermined timing (for example, whenever running time of the hydraulic excavator 100 reaches predetermined time).

In the first actuator/engine allocation map M1, the engine 9*a* is made to correspond to the boom cylinder 1 and the bucket cylinder 5, and the engine 9*b* is made to correspond to the arm cylinder 5 and the swing motor 7. In other words, during use of the first actuator/engine allocation map M1, the engine 9*a*-side closed-circuit pump set is allocated to the boom cylinder 1 or the bucket cylinder 5 in the case of driving the boom cylinder 1 or the bucket cylinder 5 first, and the engine 9*b*-side closed-circuit pump set is allocated to the arm cylinder 3 or the swing motor 7 in the case of driving the arm cylinder 3 or the swing motor 7 first.

In the second actuator/engine allocation map M2, conversely from the first actuator/engine allocation map M1, the engine 9*b* is made to correspond to the boom cylinder 1 and the bucket cylinder 5, and the engine 9*a* is made to correspond to the arm cylinder 5 and the swing motor 7. In other words, during use of the second actuator/engine allocation map M2, the engine 9*b*-side closed-circuit pump set is allocated to the boom cylinder 1 or the bucket cylinder 5 in the case of driving the boom cylinder 1 or the bucket cylinder 5 first, and the engine 9*a*-side closed-circuit pump set is allocated to the arm cylinder 3 or the swing motor 7 in the case of driving the arm cylinder 3 or the swing motor 7 first.

Reference is made back to FIG. 4. In a case in which the determination result is NO (the number of pump sets in use is not zero, that is, equal to or greater than one) in Step F101, the actuator/engine allocation computing section F6 determines whether the number of pump sets in use is one in Step F201.

In a case in which a determination result is YES (the number of pump sets in use is one) in Step F201, the actuator/engine allocation computing section F6 determines whether the pump set in use is the engine 9*a*-side closed-circuit pump set in Step F202.

In a case in which a determination result is YES (the pump set in use is the engine 9*a*-side closed-circuit pump set) in Step F202, the actuator/engine allocation computing section F6 allocates the engine 9*b*-side closed-circuit pump set to the connection requestor actuator in Step F203 and ends the flow.

In a case in which the determination result is NO (the pump set in use is the engine 9*b*-side closed-circuit pump set) in Step F202, the actuator/engine allocation computing section F6 allocates the engine 9*a*-side closed-circuit pump set to the connection requestor actuator in Step F204 and ends the flow.

In a case in which the determination result is NO (the number of pump sets in use is not one, that is, equal to or greater than two) in Step F201, the actuator/engine allocation computing section F6 determines whether the number of pump sets in use is two in Step F301.

In a case in which a determination result is YES (the number of pump sets in use is two) in Step F301, the actuator/engine allocation computing section F6 determines whether any of the closed-circuit pump sets are connected to the boom cylinder 1 in Step F302 depicted in FIG. 5.

In a case in which a determination result is NO (none of the closed-circuit pump sets are connected to the boom cylinder 1) in Step F302, the actuator/engine allocation computing section F6 determines whether any of the closed-circuit pump sets are connected to the swing motor 7 in Step F303.

In a case in which a determination result is NO (none of the closed-circuit pump sets are connected to the swing motor 7) in Step F303, the actuator/engine allocation computing section F6 acquires the estimated maximum loads of the engines 9*a* and 9*b* computed by the engine load computing section F5 in Step F304, and determines whether the estimated maximum load on the engine 9*a* is heavier than the estimated maximum load on the engine 9*b* in Step F305.

In a case in which a determination result is YES (the estimated maximum load on the engine 9*a* is heavier than the estimated maximum load on the engine 9*b*) in Step F305, the actuator/engine allocation computing section F6 allocates the engine 9*b*-side closed-circuit pump set to the connection requestor actuator in Step F306 and ends the flow.

In a case in which the determination result is NO (the estimated maximum load on the engine 9*a* is equal to or lighter than the estimated maximum load on the engine 9*b*) in Step F305, the actuator/engine allocation computing section F6 allocates the engine 9*a*-side closed-circuit pump set to the connection requestor actuator in Step F307 and ends the flow.

In a case in which the determination result is YES (any of the closed-circuit pump sets are connected to the swing motor 7) in Step F303, the actuator/engine allocation computing section F6 determines whether the engine 9*a*-side closed-circuit pump set is connected to the swing motor 7 in Step F308.

In a case in which a determination result is YES (the engine 9*a*-side closed-circuit pump set is connected to the swing motor 7) in Step F308, the actuator/engine allocation computing section F6 determines whether the connection requestor actuator is the boom cylinder 1 or the swing motor 7 in Step F309.

In a case in which a determination result is YES (the connection requestor actuator is the boom cylinder 1 or the swing motor 7) in Step F309, the actuator/engine allocation computing section F6 allocates the engine 9*b*-side closed-circuit pump set to the connection requestor actuator (the boom cylinder 1 or the swing motor 7) in Step F310 and ends the flow.

In a case in which the determination result is NO (the connection requestor actuator is the arm cylinder 3 or the bucket cylinder 5) in Step F309, the actuator/engine allocation computing section F6 allocates the engine 9*a*-side closed-circuit pump set to the connection requestor actuator (the arm cylinder 3 or the bucket cylinder 5) and ends the flow.

In a case in which the determination result is NO (the engine 9*b*-side closed-circuit pump set is connected to the swing motor 7) in Step F308, the actuator/engine allocation computing section F6 determines whether the connection requestor actuator is the boom cylinder 1 or the swing motor 7 in Step F312.

In a case in which a determination result is YES (the connection requestor actuator is the boom cylinder 1 or the swing motor 7) in Step F312, the actuator/engine allocation computing section F6 allocates the engine 9*a*-side closed-circuit pump set to the connection requestor actuator (the boom cylinder 1 or the swing motor 7) in Step F313 and ends the flow.

In a case in which the determination result is NO (the connection requestor actuator is the arm cylinder 3 or the bucket cylinder 5) in Step F312, the actuator/engine allocation computing section F6 allocates the engine 9*b*-side closed-circuit pump set to the connection requestor actuator (the arm cylinder 3 or the bucket cylinder 5) in Step F314 and ends the flow.

In a case in which the determination result is YES (any of the closed-circuit pump sets are connected to the boom cylinder 1) in Step F302, the actuator/engine allocation computing section F6 determines whether any of the closed-circuit pumps are connected to the swing motor 7 in Step F315 depicted in FIG. 6.

In a case in which a determination result is YES (any of the closed-circuit pumps are connected to the swing motor 7) in Step F315, the actuator/engine allocation computing section F6 acquires the estimated maximum loads of the engines 9*a* and 9*b* computed by the engine load computing section F5 in Step F316, and determines whether the estimated maximum load on the engine 9*a* is heavier than the estimated maximum load on the engine 9*b* in Step F317.

In a case in which a determination result is YES (the estimated maximum load on the engine 9*a* is heavier than the estimated maximum load on the engine 9*b*) in Step F317, the actuator/engine allocation computing section F6 allocates the engine 9*b*-side closed-circuit pump set to the connection requestor actuator in Step F318 and ends the flow.

In a case in which the determination result is NO (the estimated maximum load on the engine 9*a* is equal to or lighter than the estimated maximum load on the engine 9*b*) in Step F317, the actuator/engine allocation computing section F6 allocates the engine 9*a*-side closed-circuit pump set to the connection requestor actuator in Step F319 and ends the flow.

In a case in which the determination result is NO (none of the closed-circuit pumps are connected to the swing motor 7) in Step F315, the actuator/engine allocation computing section F6 determines whether the engine 9*a*-side closed-circuit pumps are connected to the boom cylinder 1 in Step F320.

In a case in which the determination result is YES (the engine 9*a*-side closed-circuit pump set is connected to the boom cylinder 1) in Step F320, the actuator/engine allocation computing section F6 determines whether the connection requestor actuator is the boom cylinder 1 or the swing motor 7 in Step F321.

In a case in which a determination result is YES (the connection requestor actuator is the boom cylinder 1 or the swing motor 7) in Step F321, the actuator/engine allocation computing section F6 allocates the engine 9*b*-side closed-circuit pumps to the connection requestor actuator (the boom cylinder 1 or the swing motor 7) in Step F322 and ends the flow.

In a case in which the determination result is NO (the connection requestor actuator is the arm cylinder 3 or the bucket cylinder 5) in Step F321, the actuator/engine allocation computing section F6 allocates the engine 9*a*-side closed-circuit pump set to the connection requestor actuator (the arm cylinder 3 or the bucket cylinder 5) in Step F323 and ends the flow.

In a case in which the determination result is NO (the engine 9*a* is allocated to the boom cylinder 1) in Step F320, the actuator/engine allocation computing section F6 determines whether the connection requestor actuator is the boom cylinder 1 or the swing motor 7 in Step F324.

In a case in which a determination result is YES (the connection requestor actuator is the boom cylinder 1 or the swing motor 7) in Step F324, the actuator/engine allocation computing section F6 allocates the engine 9*a*-side closed-circuit pump set to the connection requestor actuator (the boom cylinder 1 or the swing motor 7) in Step F325 and ends the flow.

In a case in which the determination result is NO (the connection requestor actuator is the arm cylinder 3 or the bucket cylinder 5) in Step F324, the actuator/engine allocation computing section F6 allocates the engine 9*b*-side closed-circuit pump set to the connection requestor actuator (the arm cylinder 3 or the bucket cylinder 5) in Step F326 and ends the flow.

Reference is made back to FIG. 4. In a case in which the determination result is NO (the number of pump sets in use is not two, that is, equal to or greater than three) in Step F301, the actuator/engine allocation computing section F6 determines whether the two engine 9*a*-side closed-circuit pump sets are both in use in Step F401.

In a case in which a determination result is YES (the two engine 9*a*-side closed-circuit pump sets are both in use) in Step F401, the actuator/engine allocation computing section F6 allocates the engine 9*b*-side closed-circuit pump set to the connection requestor actuator and ends the flow.

In a case in which the determination result is NO (one of the two engine 9*a*-side closed-circuit pump sets is not in use) in Step F401, the actuator/engine allocation computing section F6 allocates the engine 9*a*-side closed-circuit pump set to the connection requestor actuator and ends the flow.

Operations of the hydraulic closed-circuit system configured as described above will be described while comparing with a case of applying control according to the conventional technology to operations of the hydraulic closed-circuit system.

<Operations in the Case of Applying Control According to the Conventional Technology>

Figure 8:
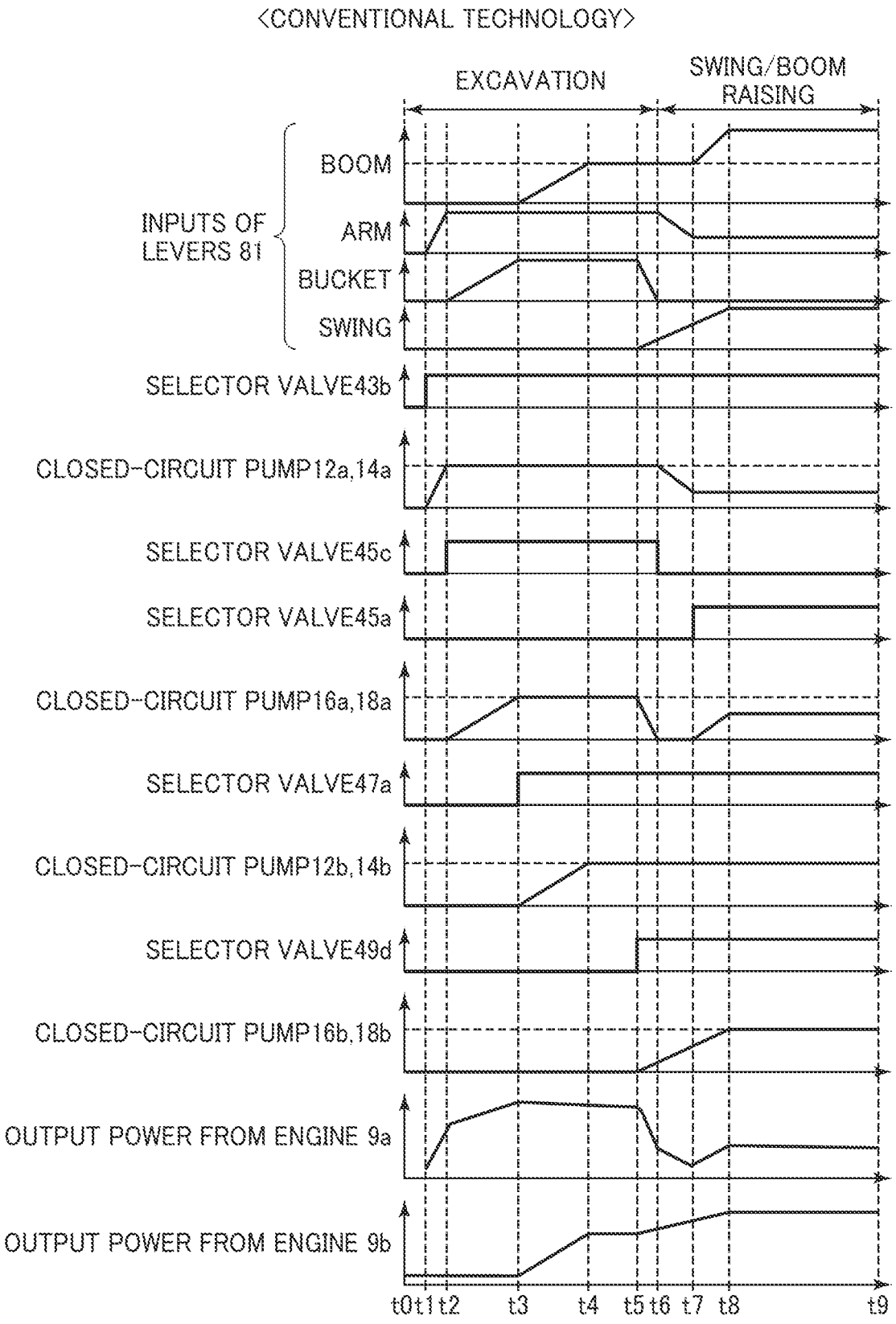
FIG. 8 is a diagram depicting changes in lever inputs, delivery flow rates of closed-circuit pumps, states of selector valves, and output power from engines in a case in which a hydraulic closed-circuit system to which control according to a conventional technology is applied and which has a configuration similar to that of FIG. 2 performs an excavating operation to swing/boom raising operations.

FIG. 8 depicts changes in inputs of the levers 81, delivery flow rates of the closed-circuit pumps 12*a* and 14*a*, 16*a* and 18*a*, 12*b* and 14*b*, and 16*b* and 18*b*, states of the selector valves 43*a* to 43*d*, 45*a* to 45*d*, 47*a* to 47*d*, and 49*a* to 49*d*, and output power from the engines 9*a* and 9*b* in a case in which a hydraulic closed-circuit system to which control according to the conventional technology is applied and which has a configuration similar to that of FIG. 2 performs an excavating operation to swing/boom raising operations. It is noted that in the case of driving the single-rod hydraulic cylinders 1, 3, and 5, delivery flow rates of the open-circuit pumps 13*a* and 15*a*, 17*a* and 19*a*, 13*b* and 15*b*, and 17*b* and 19*b* or discharge flow rates of the bleed-off valves 64 to 67 tend to be the same as the delivery flow rates of the closed-circuit pumps 12*a* and 14*a*, 16*a* and 18*a*, 12*b* and 14*b*, and 16*b* and 18*b*, and states of the selector valves 44*a* to 44*c*, 46*a* to 46*c*, 48*a* to 48*c*, and 50*a* to 50*c* are the same as the states of the selector valves 45*a* to 45*c*, 47*a* to 47*c*, and 49*a* to 49*c*; thus, description of the open-circuit pumps 13*a* and 15*a*, 17*a* and 19*a*, 13*b* and 15*b*, and 17*b* and 19*b*, the bleed-off valves 64 to 67, and the selector valves 44*a* to 44*c*, 46*a* to 46*c*, 48*a* to 48*c*, and 50*a* to 50*c* will be omitted.

In FIG. 8, clock times t0 to t6 are a section in which the excavating operation is performed, and clock times t6 to t9 are time at which the swing/boom raising operations are performed.

From the clock time t0 to the clock time t1, there are no inputs of the levers 81 and all pump flow rates are zero.

From the clock time t1 to the clock time t2, there is an input of the arm lever. At the clock time t1, none of the closed-circuit pump sets are in use; thus, the engine 9*a*-side closed-circuit pump set (for example, closed-circuit pumps 12*a* and 14*a*) is allocated to the arm cylinder 3. At the clock time t1, the selector valve 43*b* is opened, and the closed-circuit pumps 12*a* and 14*a* are connected to the arm cylinder 3. The delivery flow rates of the closed-circuit pumps 12*a* and 14*a* vary depending on the input of the lever 81.

From the clock time t2 to the clock time t3, there is an input of the bucket lever. Since the pumps other than the closed-circuit pumps 12*a* and 14*a* are not in use at the clock time t2, the engine 9*a*-side unused closed-circuit pump set (closed-circuit pumps 16*a* and 18*a*) is allocated to the bucket cylinder 5. At the clock time t2, the selector valve 45*c* is opened and the closed-circuit pumps 16*a* and 18*a* are connected to the bucket cylinder 5. Delivery flow rates of the closed-circuit pumps 16*a* and 18*a* vary depending on the input of the lever 81.

From the clock time t3 to the clock time t4, there is an input of the boom lever. Since the two engine 9*a*-side closed-circuit pump sets (closed-circuit pumps 12*a* and 14*a*, and 16*a* and 18*a*) are in use at the clock time t3, the engine 9*b*-side closed-circuit pump set (for example, the closed-circuit pumps 12*b* and 14*b*) is allocated to the boom cylinder 1. At the clock time t3, the selector valve 47*a* is opened and the closed-circuit pumps 12*b* and 14*b* are connected to the boom cylinder 1. Delivery flow rates of the closed-circuit pumps 12*b* and 14*b* vary depending on the input of the lever 81.

From the clock time t5 to the clock time t8, there is an input of the swing lever. Since only the engine 9*b*-side closed-circuit pumps 16*b* and 18*b* are not in use at the clock time t5, the closed-circuit pumps 16*b* and 18*b* are allocated to the swing motor 7. At the clock time t5, the selector valve 49*d* is opened and the closed-circuit pumps 16*b* and 18*b* are connected to the swing motor 7. Delivery flow rates of the closed-circuit pumps 16*b* and 18*b* vary depending on the input of the lever 81.

From the clock time t5 to the clock time t6, the input of the bucket lever becomes zero. At the clock time t6, the delivery flow rates of the closed-circuit pumps 16*a* and 18*a* become zero and the selector valve 45*c* is closed.

From the clock time t7 to the clock time t8, the input of the boom lever increases. Since only the engine 9*a*-side closed-circuit pumps 16*a* and 18*a* are not in use at the clock time t7, the closed-circuit pumps 16*a* and 18*a* are allocated to the boom cylinder 1. At the clock time t7, the selector valve 45*a* is opened and the closed-circuit pumps 16*a* and 18*a* are connected to the boom cylinder 1. Delivery flow rates of the closed-circuit pumps 16*a* and 18*a* vary depending on the input of the lever 81.

In an example depicted in FIG. 8, the closed-circuit pump sets are allocated to the connection requestor actuators in order from the engine 9*a*-side closed-circuit pump sets; thus, the loads are unevenly imposed on the engine 9*a* side in the first half excavating operation (clock times t2 to t5), and the loads are unevenly imposed on the engine 9*b* side in the second half swing/boom raising operations (clock times t6 to t9). In the hydraulic excavator 100 in which the loads of the hydraulic actuators 1, 3, 5, and 7 are possibly unevenly imposed on one of the engines in this way, occurrence of a scarcity of power in the one engine possibly causes degradation in work efficiency. It is, therefore, necessary to make the engines 9*a* and 9*b* large in size to maintain high work efficiency.

<Operations According to the Present Embodiment>

Figure 9:
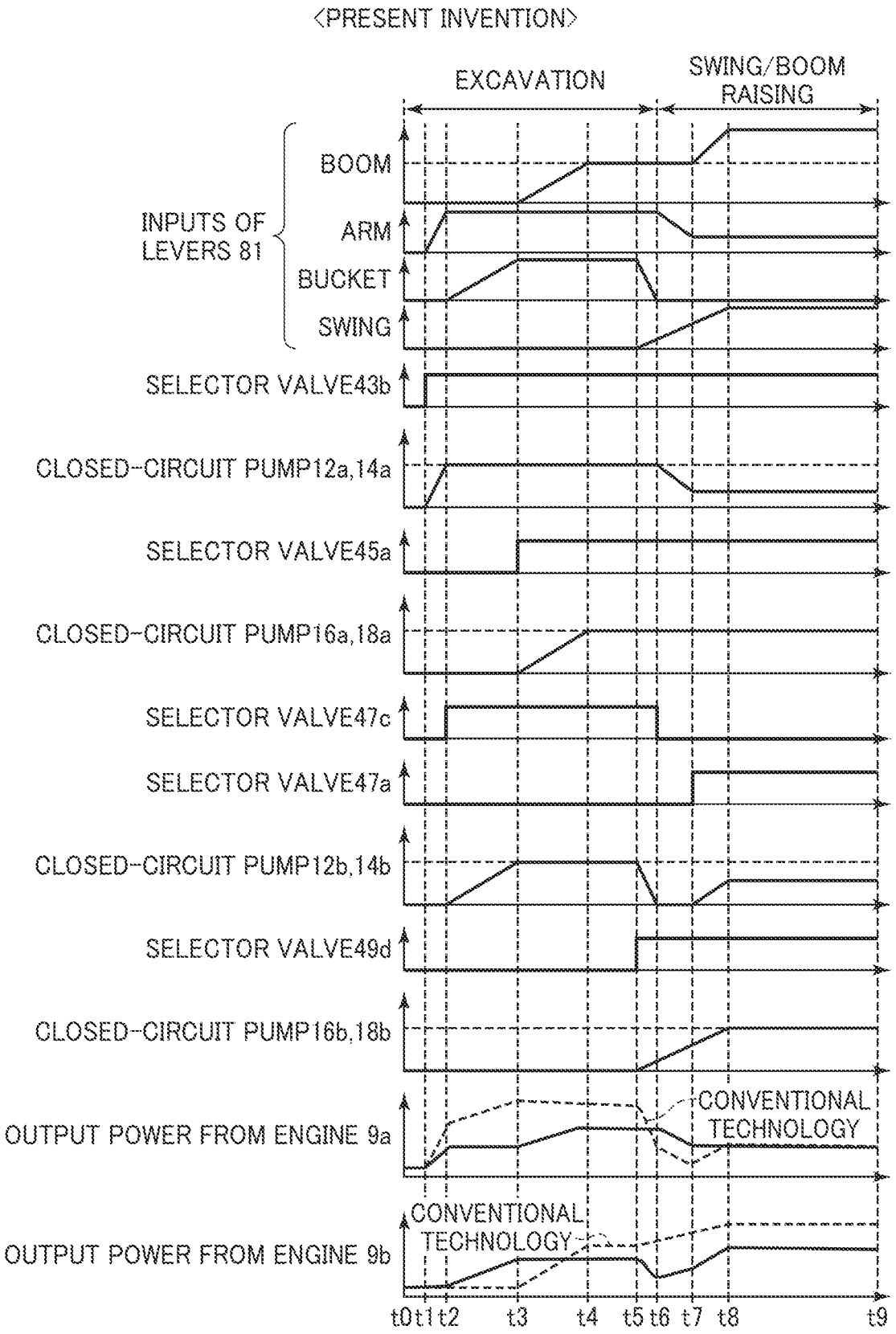
FIG. 9 is a diagram depicting changes in lever inputs, delivery flow rates of closed-circuit pumps, states of selector valves, and output power from engines in a case in which the hydraulic closed-circuit system according to the embodiment of the present invention performs an excavating operation to swing/boom raising operations.

FIG. 9 depicts changes in the inputs of the levers 81, delivery flow rates of the closed-circuit pumps 12*a* and 14*a*, 16*a* and 18*a*, 12*b* and 14*b*, and 16*b* and 18*b*, states of the selector valves 43*a* to 43*d*, 45*a* to 45*d*, 47*a* to 47*d*, and 49*a* to 49*d*, and output power from the engines 9*a* and 9*b* in a case in which the hydraulic closed-circuit system according to the present embodiment performs an excavating operation to swing/boom raising operations. For brevity of description, it is assumed that the pressures of all actuators are identical.

In FIG. 9, clock times t0 to t6 are a section in which an excavating operation is performed, and clock times t6 to t9 are a time at which swing/boom raising operations are performed.

From the clock time t0 to the clock time t1, there are no inputs of the levers 81 and all pump flow rates are zero.

From the clock time t1 to the clock time t2, there is an input of the arm lever. Since none of the closed-circuit pump sets are in use (the determination result is YES in Step F101) at the clock time t1, any of the engine 9*a*-side closed-circuit pump sets (closed-circuit pumps 12*a* and 14*a*) are allocated to the arm cylinder 3 on the basis of, for example, the second actuator/engine allocation map M2 (depicted in FIG. 7) (Step F102). At the clock time t1, the selector valve 43*b* is opened and the closed-circuit pumps 12*a* and 14*a* are connected to the arm cylinder 3. The delivery flow rates of the closed-circuit pumps 12*a* and 14*a* vary depending on the input of the lever 81.

From the clock time t2 to the clock time t3, there is an input of the bucket lever. Since the engine 9*a*-side closed-circuit pumps 12*a* and 14*a* are in use for the arm cylinder 3 (the determination result is YES in Step F202) at the clock time t2, any of the engine 9*b*-side closed-circuit pump sets (for example, closed-circuit pumps 12*b* and 14*b*) are allocated to the bucket cylinder 5 (Step F203). At the clock time t2, the selector valve 47*c* is opened and the closed-circuit pumps 12*b* and 14*b* are connected to the bucket cylinder 5. Delivery flow rates of the closed-circuit pumps 12*b* and 14*b* vary depending on the input of the lever 81.

From the clock time t3 to the clock time t4, there is an input of the boom lever. At the clock time t3, the closed-circuit pump set is not in use for the boom cylinder (the determination result is NO in Step F302), the closed-circuit pump set is not in use for the swing motor 7 (the determination result is NO in Step F303), and the estimated maximum load on the engine 9*a* (=the estimated maximum demanded power of the closed-circuit pumps 12*a* and 14*a* connected to the arm cylinder 3) is identical to the estimated maximum load on the engine 9*b* (=the estimated maximum demanded power of the closed-circuit pumps 12*b* and 14*b* connected to the bucket cylinder 5) (the determination result is NO in Step F305); thus, the engine 9*b*-side unused closed-circuit pump set (closed-circuit pumps 16*a* and 18*a*) is allocated to the boom cylinder 1 (Step F307). At the clock time t3, the selector valve 45*a* is opened and the closed-circuit pumps 16*a* and 18*a* are connected to the boom cylinder 1. Delivery flow rates of the closed-circuit pumps 16*a* and 18*a* vary depending on the input of the lever 81.

From the clock time t5 to the clock time t8, there is an input of the swing lever. At the clock time t5, the three closed-circuit pump sets are in use (the determination result is NO in Step F301), and the two engine 9*a*-side closed-circuit pump sets (closed-circuit pumps 12*a* and 14*a*, and 16*a* and 18*a*) are in use (the determination result is YES in Step F401); thus, the engine 9*b*-side unused closed-circuit pump set (closed-circuit pumps 16*b* and 18*b*) is allocated to the swing motor 7 (Step F402 of FIG. 4). At the clock time t5, the selector valve 49*d* is opened and the closed-circuit pumps 16*b* and 18*b* are connected to the swing motor 7. Delivery flow rates of the closed-circuit pumps 16*b* and 18*b* vary depending on the input of the lever 81.

From the clock time t5 to the clock time t6, the input of the bucket lever becomes zero. At the clock time t6, the delivery flow rates of the closed-circuit pumps 12*b* and 14*b* become zero and the selector valve 47*c* is closed.

From the clock time t7 to the clock time t8, the input of the boom lever increases. At the clock time t7, the three closed-circuit pump sets are in use (the determination result is NO in Step F301), and the two engine 9*a*-side closed-circuit pump sets (closed-circuit pumps 12*a* and 14*a*, and 16*a* and 18*a*) are in use (the determination result is YES in Step F401); thus, the engine 9*b*-side unused closed-circuit pump set (closed-circuit pumps 12*b* and 14*b*) is allocated to the boom cylinder 1 (Step F403). At the clock time t7, the selector valve 47*a* is opened and the closed-circuit pumps 16*a* and 18*a* are connected to the boom cylinder 1. Delivery flow rates of the closed-circuit pumps 16*a* and 18*a* vary depending on the input of the lever 81.

In an example depicted in FIG. 9, the closed-circuit pumps on the engine side having the lighter estimated maximum load are allocated to the connection requestor actuators; thus, the loads of the engines 9*a* and 9*b* are leveled out in the first half excavating operation (the clock times t2 to t5) and the second half swing/boom raising operations (the clock times t5 to t9), compared with the case of applying the control according to the conventional technology (indicated by broken lines in FIG. 9).

According to the hydraulic excavator 100 according to the present embodiment configured as described above, connecting the closed-circuit pump set driven by the engine having the lighter estimated maximum load out of the engines 9*a* and 9*b* to the hydraulic actuator requesting connection of the closed-circuit pump set to the hydraulic actuator enables leveling out the maximum demanded power of the engines 9*a* and 9*b*. It is thereby possible to downsize the engines 9*a* and 9*b* while maintaining the work efficiency of the hydraulic excavator 100 high.

Furthermore, determining first the closed-circuit pump sets connected to the hydraulic actuators 1, 3, 5, and 7 on the basis of the first or second actuator/engine allocation map M1 or M2 facilitates distributing the loads of the two hydraulic actuators (the boom cylinder 1 and the swing motor 7) highest in a stationary load to the two engines 9*a* and 9*b*.

Furthermore, using the first and second actuator/engine allocation maps M1 and M2 by changing over between the first and second actuator/engine allocation maps M1 and M2 at predetermined timing makes it possible to level out usage frequencies and time of use of the engines 9*a* and 9*b* for each of the hydraulic actuators 1, 3, 5, and 7 for a long period of time. It is noted that the predetermined timing is not limited to specific timing if the usage frequencies of the hydraulic pumps can be made uniform, and may be sufficiently shorter than a pump estimated life (equal to or longer than several thousand hours) and sufficiently longer than a cycle time of an excavation and loading operation making up a highest proportion of the running time of the hydraulic excavator. Examples of the predetermined timing include after running for 24 hours.

While the embodiment of the present invention has been described in detail, the present invention is not limited to the embodiment and encompasses various modifications. For example, the present invention has been described while the hydraulic excavator is taken by way of example in the above embodiment; however, the present invention is also applicable to construction machines other than the hydraulic excavator. Furthermore, the above embodiment has been described in detail for facilitating understanding the present invention, and the present invention is not always limited to the construction machine having all the configurations described above.

DESCRIPTION OF REFERENCE CHARACTERS

1: Boom cylinder (hydraulic actuator)
2: Boom
3: Arm cylinder (hydraulic actuator)
4: Arm
5: Bucket cylinder (hydraulic actuator)
6: Bucket
7: Swing motor (hydraulic actuator)
8*a*, 8*b*: Travel motor (hydraulic actuator)
9*a*: Left engine (first engine)
9*b*: Right engine (second engine)
10*a*, 10*b*: Power transmission device
12*a*, 14*a*, 16*a*, 18*a*: Closed-circuit pump (first hydraulic pump)
12*b*, 14*b*, 16*b*, 18*b*: Closed-circuit pump (second hydraulic pump)
13*a*, 13*b*, 15*a*, 15*b*, 17*a*, 17*b*, 19*a*, 19*b*: Open-circuit pump
25: Hydraulic operating fluid tank
43*a* to 43*d*, 44*a* to 44*d*, 45*a* to 45*d*, 46*a* to 46*d*, 47*a* to 47*d*, 48*a* to 48*d*, 49*a* to 49*d*, 50*a* to 50*d*: Selector valve
54, 55: Control valve
64 to 67: Bleed-off valve
70: Hydraulic valve block
80: Controller
81: Levers (operation device)
82*a*, 82*b*, 83*a*, 83*b*, 84*a*, 84*b*, 85*a*, 85*b*: Pressure sensor (pressure sensor)
100: Hydraulic excavator (construction machine)
101: Lower travel structure
101*a*, 101*b*: Travel device
102: Upper swing structure
102*a*: Swing device
103: Front implement
104: Swing frame
105: Counterweight
106: Cab
107: Left engine room
108: Right engine room
F1: Lever operation amount computing section
F2: Actuator pressure computing section
F3: Command computing section
F4: Number-of-pumps-allocated-to-actuator computing section
F5: Engine estimated maximum load computing section
F6: Actuator/engine allocation computing section
F7: Command computing section

The invention claimed is:

1. A construction machine comprising:
a first engine;
a second engine;
a plurality of bidirectionally variable displacement first hydraulic pumps driven by the first engine;
a plurality of bidirectionally variable displacement second hydraulic pumps driven by the second engine;
a plurality of hydraulic actuators;
an operation device for instructing operation amounts of the plurality of hydraulic actuators;
a plurality of selector valves selectively connecting the plurality of first hydraulic pumps and the plurality of second hydraulic pumps to any one of the plurality of hydraulic actuators; and
a controller controlling the plurality of first hydraulic pumps, the plurality of second hydraulic pumps, and the plurality of selector valves according to an input from the operation device, wherein
the controller includes
an engine load computing section that computes a total of estimated maximum demanded power of first hydraulic pumps connected to the plurality of hydraulic actuators among the plurality of first hydraulic pumps as an estimated maximum load on the first engine, and that computes a total of estimated maximum demanded power of second hydraulic pumps connected to any of the plurality of hydraulic actuators among the plurality of second hydraulic pumps as an estimated maximum load on the second engine,
an actuator/engine allocation computing section that, at a time of connecting first or second hydraulic pumps that are not connected to any of the plurality of hydraulic actuators among the plurality of first hydraulic pumps and the plurality of second hydraulic pumps to any one of the plurality of hydraulic actuators, allocates second hydraulic pumps that are not connected to any of the plurality of hydraulic actuators among the plurality of second hydraulic pumps to the one hydraulic actuator in a case in which the estimated maximum load on the first engine is heavier than the estimated maximum load on the second engine, and allocates first hydraulic pumps that are not connected to any of the plurality of hydraulic actuators among the plurality of first hydraulic pumps to the one hydraulic actuator in a case in which the estimated maximum load on the second engine is heavier than the estimated maximum load on the first engine, and a command generation section that generates command signals to the plurality of first hydraulic pumps, the plurality of second hydraulic pumps, and the plurality of selector valves according to a computing result of the actuator/engine allocation computing section.

2. The construction machine according to claim 1, comprising:

a pressure sensor that detects pressures of the plurality of actuators, wherein the engine load computing section computes the estimated maximum demanded power of the first hydraulic pumps by performing multiplication of a rated revolution speed of the first engine, a maximum delivery capacity of the first hydraulic pumps, and a differential pressure between estimated delivery pressures and estimated suction pressures of the first hydraulic pumps computed on a basis of the pressure of the hydraulic actuator to which the first hydraulic pumps are connected, and computes the estimated maximum demanded power of the second hydraulic pumps by performing multiplication of a rated revolution speed of the second engine, a maximum tilting angle, and the pressure of the hydraulic actuator to which the second hydraulic pumps are connected.

3. The construction machine according to claim 1, wherein the actuator/engine allocation computing section has a first actuator/engine allocation map that makes each of the plurality of hydraulic actuators correspond to the first or second engine, and allocates the first or second hydraulic pumps driven by the first or second engine made to correspond to the one hydraulic actuator by the first actuator/engine allocation map to the one hydraulic actuator in a case of driving the one hydraulic actuator first.

4. The construction machine according to claim 3, comprising:

a lower travel structure;

an upper swing structure swingably mounted onto the lower travel structure; and a boom vertically rotatably attached to a front side of the upper swing structure, wherein the plurality of hydraulic actuators include a swing motor that drives the upper swing structure and a boom cylinder that drives the boom, and the first actuator/engine allocation map makes one of the first and second engines correspond to the boom cylinder, and the other of the first and second engines correspond to the swing motor.

5. The construction machine according to claim 3, wherein the actuator/engine allocation computing section further has a second actuator/engine allocation map that makes the hydraulic actuators, having been made to correspond to the first engine by the first actuator/engine allocation map, correspond to the second engine, and that makes the hydraulic actuators, having been made to correspond to the second engine by the first actuator/engine allocation map, correspond to the first engine, and uses the first actuator/engine allocation map and the second actuator/engine allocation map by changing over between the first actuator/engine allocation map and the second actuator/engine allocation map at predetermined timing.

* * * * *